US007828534B2

(12) United States Patent
Habr

(10) Patent No.: US 7,828,534 B2
(45) Date of Patent: Nov. 9, 2010

(54) DISPLACEMENT MACHINE INCLUDING AT LEAST TWO ADJACENT WORKING CHAMBERS

(75) Inventor: Klaus Habr, Mortheidoufeld (DE)

(73) Assignee: Robert Bosch GmbH, Stuttgart (DE)

( * ) Notice: Subject to any disclaimer, the term of this patent is extended or adjusted under 35 U.S.C. 154(b) by 865 days.

(21) Appl. No.: 11/728,687

(22) Filed: Mar. 26, 2007

(65) Prior Publication Data

US 2007/0253835 A1 Nov. 1, 2007

(30) Foreign Application Priority Data

Apr. 10, 2006 (DE) ..... 10 2006 016 806

(51) Int. Cl.
*F01C 21/00* (2006.01)
*F03C 2/00* (2006.01)
*F03C 4/00* (2006.01)

(52) U.S. Cl. ..... 418/152; 418/45; 418/153; 417/474; 417/476

(58) Field of Classification Search ..... 418/45, 418/48, 152, 153, 235; 417/474, 476
See application file for complete search history.

(56) References Cited

U.S. PATENT DOCUMENTS

| | | | | |
|---|---|---|---|---|
| 2,794,400 A | | 6/1957 | Bodine | |
| 2,906,143 A | * | 9/1959 | Walton | 418/150 |
| 2,910,006 A | * | 10/1959 | Walton | 418/45 |
| 4,102,612 A | | 7/1978 | Ritter | |
| 4,390,328 A | * | 6/1983 | Fickelscher | 418/45 |
| 5,131,823 A | | 7/1992 | Guignard | |
| 5,350,284 A | | 9/1994 | Wehling | |

FOREIGN PATENT DOCUMENTS

| | | |
|---|---|---|
| DE | 43 32 540 | 3/1995 |
| DE | 10 2004 024 641 | 12/2005 |
| GB | 2416810 | 2/2006 |
| WO | WO0227185 | 4/2002 |

* cited by examiner

*Primary Examiner*—Theresa Trieu
(74) *Attorney, Agent, or Firm*—Kenyon & Kenyon LLP

(57) ABSTRACT

A displacement machine has at least two adjacent working chambers which are defined by: a) a common first wall section made of an elastic material; b) a common second wall section; and c) a movable element which is movable with respect to the first wall section, which movable element has a press-on section that presses the first wall section against the second wall section to form a common sealing region between the two adjacent working chambers, which common sealing region moves with the movement of the press-on section. At least one of the first and second wall sections is provided with a non-smooth profile on the inner side of the working chambers.

12 Claims, 4 Drawing Sheets

DISPLACEMENT MACHINE INCLUDING AT LEAST TWO ADJACENT WORKING CHAMBERS

BACKGROUND OF THE INVENTION

1. Field of the Invention

The present invention relates to a displacement machine which may be operated both as a pump and as a motor.

2. Description of Related Art

Displacement machines are known in a wide variety of embodiments. In displacement machines the medium is conveyed through volumes closed in on themselves. To do this, at least two adjacent working chambers are provided which are variable as to volume. The flowing back of the medium from the working chamber on the pressure side into the working chamber on the suction side is prevented by a shifting sealing line between the working chambers.

One embodiment of a displacement machine is described in published German patent document DE 43 32 540. The flying vane pump shown in this German patent document has a rotor having radially movable vane elements which are under pressure on their radially inner side. The vane elements separate working chambers that are apart in the circumferential direction. The vane elements glide along a metallic curve ring using their radially outer sides. Because of this, sealing gaps are formed between the radial outer sides of the vane elements and the curve ring. These shift together with the vane elements of the rotor, in the circumferential direction. The provision of sealing gaps assumes great manufacturing accuracy to minimize leakage, and, depending on the design variant, is a limiting factor for use in the field of high pressure, or for working media having low viscosity.

Another embodiment of a displacement machine is described in published German patent document DE 10 2004 024 641. This German patent document shows a hose (peristaltic) pump in which the medium to be conveyed is guided through a hose. In the known hose pump, the hose is supported on the one side on an press-on rod (A), and is clamped off from inside by a rotor having rollers that are circumferentially at a distance, whereby adjacent, variable volume working chambers are formed. In response to the rotation of the rotor, the sealing region moves along the hose, and thereby drives the conveyed medium forwards. The disadvantage of the known hose pump is that high contact pressures between the rotor, or rather, between the rollers and the hose have to be expended in order to prevent the flowing back of the medium that is to be conveyed. It is also a disadvantage that the hose has only a short service life because of the powerful milling effect and the compressive load that occurs.

BRIEF SUMMARY OF THE INVENTION

An object of the present invention is to provide a displacement machine in which, using simple means, leakproof sealing is ensured between two adjacent working chambers, at a simultaneous minimal material loading.

The present invention is based on the idea of profiling at least one common wall section of the variable volume working chambers on the inner sides of the working chambers. It is conceivable, for instance, to provide a sort of sawtooth profile, the teeth preferably extending transversely to the direction of motion of the moved element and being at a distance from one another in the direction of motion. At least the first, elastic wall section, which may be formed of an elastomeric plastic, is provided with a profiling on its inner side. Leakproof sealing is achieved between the two working chambers by the profiling. Substantially lower contact pressures are required to ensure the sealing between the working chambers. The improved sealing effect of the profiling is supported by the pressure exerted on the profiling by the working medium on the pressure side, which forces the sealing contact of the profiling with the opposite wall section. Based on the improved sealing of the adjacent working chambers from each other, the displacement machine according to the present invention is suitable for use in the field of high pressures and/or for working media having a low viscosity. The displacement machine according to the present invention is especially suitable as a drive for machine tools, e.g., for drilling machines, and in addition it can be used in robotics as well as in automation technology.

During the operation of the displacement machine, the movable element with its at least one press-on section along the outer side of the elastic wall section. In the region of the pressure section, the inner side of the elastic, first wall section lies against an opposite, second wall section, whereby a moved sealing region or a moving sealing line is formed in common with the press-on section or the movable element. The profiling of at least one of the wall sections takes care of the leakproof sealing, in this instance. Because of the moving sealing region or the moving clamp-off location, the medium is conveyed ahead in the pumping operation. If the displacement machine is used as a motor, the medium drives the press-on section, and thereby the movable element.

According to one example embodiment, the elastic, first wall section is supported on a rigid component on its entire outer surface. This rigid component can be especially the movable element. The rigid component is used to accommodate pressure force, and thus to the removal of load from the elastic wall section. The elastic wall section itself does not have to compensate for the pressure forces of the medium to be conveyed, but may pass this off completely to the components surrounding it. Since the elastic wall section does not have to accommodate the loads of the working pressure, the elastic wall section is left only to perform the function of a pressure stress transmitter.

It is conceivable that one might form the second common wall section of the working chambers from a rigid, non-deformable material, such as a plastic or a metal. In response to this design, the load of the working pressure is taken up, on the one hand, by this second wall section and, on the other hand, by the rigid component that supports the first wall section on the outside.

According to an example embodiment of the present invention, all the wall sections surrounding the working chambers are developed of an elastic material. All the wall sections may be manufactured of the same elastomeric material. By contrast to a usual hose pump, all the elastic wall sections are supported over their whole surface on their outer side. Consequently, the elastic material does not have to accommodate the pressure loads of the working medium. The pressure forces are guided to the rigid and non-deformable components that support the elastic material from outside. The service life of the elastomer is considerably increased thereby. In response to the relative motion of the movable element, using its at least one press-on section, with respect to the elastic first wall section, the entire elastomer, while maintaining its overall volume in a pressure-supported manner, is so strongly deformed that the gap between the first wall section and the second wall section is bridged thereby. The two wall sections enclosing the working chambers may be designed as a one-piece, hose-shaped, elastomeric plastic profile.

Because all the elastic wall sections are supported by rigid components, and based on the profiling of the inside of at least one wall section, and because the displacement space is sealed elastically supported by pressure, hydraulic pumps and motors are able to be constructed in a leakproof manner for considerably higher pressures using a working medium having a substantially lower viscosity. Entirely new fields of application come about for hydraulic machines, based on the high performance density gathered from the design according to the present invention. Because of the leakproof sealing according to the present invention, the size of known displacement machines can be substantially reduced.

In an example embodiment of the present invention, it is provided that the inner sides of all the wall sections have profiles. It is of especial advantage if the inside of the second wall section, that lies opposite the first wall section, is profiled in a form complementary to the profiling of the first wall section. For instance, both inner sides are profiled in sawtooth fashion or in wave form, the wave hills of the one inner side engaging with the wave valleys of the opposite inner side when they are pressed together. The sealed region then moves in the manner of a zipper, along the inner sides of the adjacent working chambers. An elastic, pressure-supported sealing effect is created thereby, so that one may work with even higher working pressures and working media having even lower viscosities.

For the reinforcement of regions of the elastic wall sections that are in danger of tensile stress, reinforcement layer can be provided. It is conceivable that one might reinforce all the elastic wall sections, using in each case at least one reinforcement layer, for instance, made of a woven fabric, a plastic and/or a metal. In this context, the reinforcement layer can be completely surrounded by elastomer or it can rise to the surface of the elastic wall section. It is conceivable, for instance, that the reinforcement layer itself forms the inner side of an elastic wall section, and thus of the working chambers. If, for example, at least one partial section of an elastic wall section is reinforced at its outer side, using a reinforcement layer, depending on the firmness of the reinforcement layer, one can do without the outer support of this section for passing on the pressure to an additional rigid component, since, in this region, the reinforcement layer accommodates or compensates for the inner pressure or the forces resulting from it.

According to an example embodiment of the present invention, it is provided that between the first elastic wall section and the moved element, means are provided for reducing friction. These means reduce the friction between the element moved relatively to the first wall section and the outer side of the first wall section. As the means for reducing friction, sliding bands, needle roller bands and ball belts, or a combination of these, are particularly suitable. In addition or alternatively, it is also conceivable to provide means for reducing friction between at least one of the elastic wall sections and a lateral support. This is advantageous, since the elastomer performs a relative motion towards the lateral support, in response to having the press-on section applied to it.

Basically, it is possible to develop the displacement machine according to the present invention to work in a translatory as well as a rotary fashion. According to an example embodiment of the present invention, the moved element is designed as a rotor and is surrounded by the working chambers in the circumferential direction at least partially, but may be surrounded entirely. The at least one press-on section of the rotor is moved in the circumferential direction, as a result of which the sealing region between the first elastic wall section and the second wall section also travels in the circumferential direction.

In an example embodiment of the present invention it is provided that the working chambers are completely enclosed by elastic material. In this case, an internally profiled hose is formed of elastomeric material, which is subdivided into separate working chambers by applying the press-on sections. It can, of course, be provided in this instance that on the inside or in the outer region of the elastic material reinforcement layers are provided. The elastomer hose may be completely supported by pressure on its outside, that is, radially outwards it lies against a stator, and radially inwards against a rotor or against friction-reducing means that lie against the rotor. In addition, the elastomer hose is also supported laterally, for instance by sidewalls of a groove inserted into the stator, and/or by side disks.

DETAILED DESCRIPTION OF THE INVENTION

Figure 1:
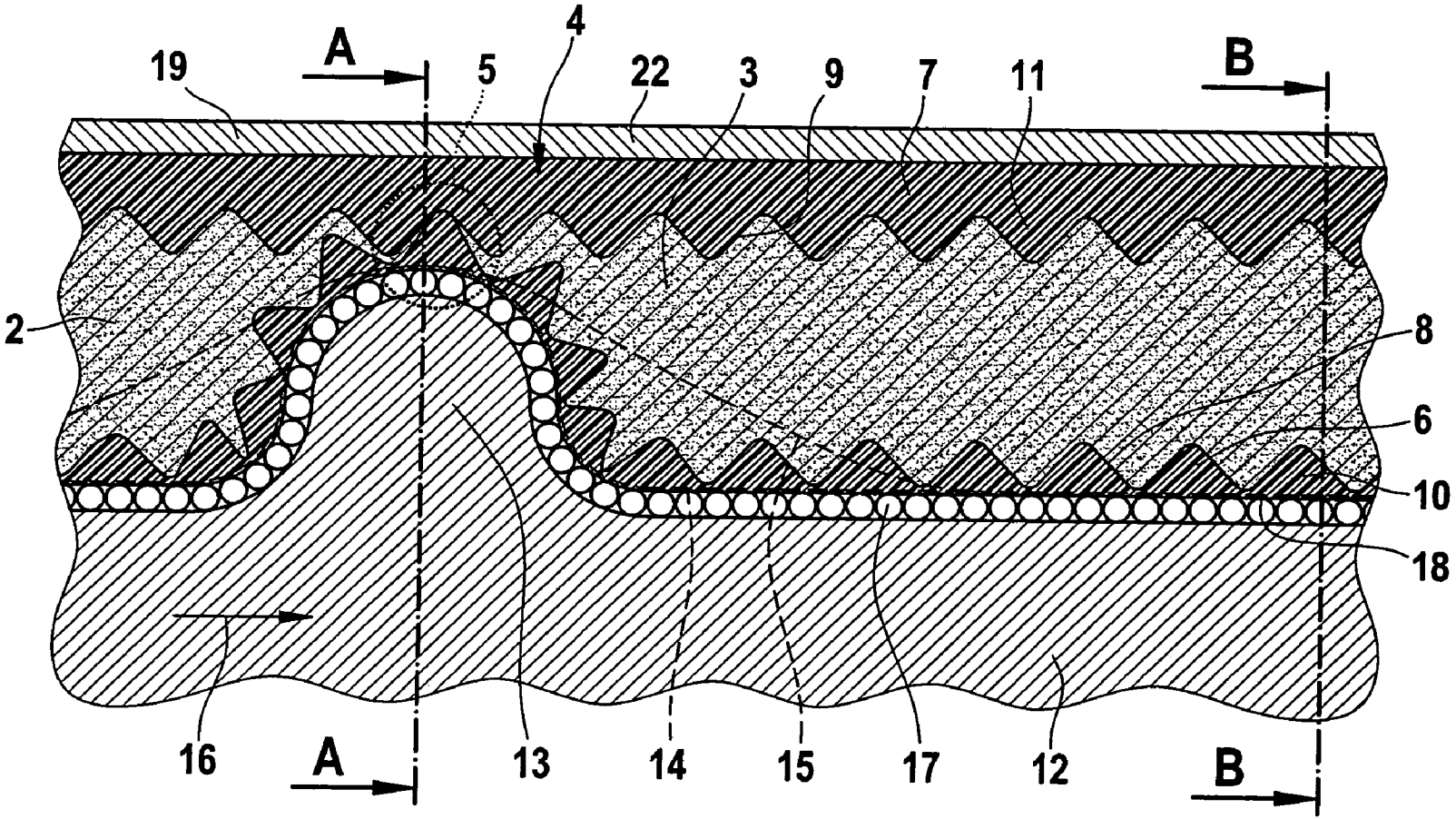
FIG. 1 shows a schematic representation of the main components of a displacement machine according to the present invention.

In the figures, the same components and components having the same function are designated by the same reference numerals.

The main components of a displacement machine 1 according to the present invention are shown in FIG. 1. This machine can be both a rotary and a translatory displacement machine or working machine. Displacement machine 1 has a first variable volume and an adjacent second variable volume working chamber 2, 3. In the exemplary embodiment shown, second working chamber 3 is a working chamber on the pressure side, and working chamber 2 is a working chamber on the sucking side. Inlet and outlet openings are not shown. The two working chambers 2, 3 are situated in a hose-shaped elastomer 4. The two working chambers 2, 3 are sealed in a leakproof manner from each other by a sealing region 5. Elastomer 4 is made up of a first elastic wall section 6 that is common to the two working chambers 2, 3, and an opposite, second wall section 7 that is common to the two working chambers 2, 3. Both wall sections 6, 7 are furnished with a profiling 10, 11, respectively, on their inner side 8, 9, facing working chambers 2, 3. The profiles 10, 11 are provided with elevations and depressions, in the transverse direction of wall sections 6, 7, that are wave-shaped or sawtooth-shaped (knob-shaped, shaped like a circle or part of a circle, shaped like an ellipse or part of an ellipse, trapeze-shaped, tetrahedron-shaped, polygon-shaped, Bézier curve-shaped or any combination of the above-named profile shapes). Profiles 10, 11 are designed as complementary shapes with respect to each other, and engage with each other in sealing region 5 in gearing fashion. It is conceivable that one might provide only one of wall sections 6, 7 with a profile 10, 11.

In the plane of the drawing, below first elastic wall section 6, a movable element 12 is situated having a press-on section 13 that is raised in the direction of second wall section 7. Two conceivable contour curves of press-on section 13 are indicated by two dashed lines 14, 15. Contour curve 15 is developed flatter than contour curve 14, in this context.

The movable element moves together with press-on section 13, that is developed as one piece with movable element 12, relatively to first wall section 6 in the direction of arrow 16 if displacement machine 1 is designed as a pump, and thereby it transports the liquid volume in second working chamber 3 also in direction of arrow 16.

In the case of the operation of displacement machine 1 as a motor, movable element 12 moves counter to direction of arrow 16, and is driven by the medium, in second working chamber 3, that is under pressure.

With the aid of press-on section 13, first wall section 6 is pressed against second wall section 7, in the region of press-on section 13, as shown, whereby sealing region 5 is created. This travels together with press-on section 13 in the direction of arrow 16 or counter to it. In order to reduce the friction during the relative motion between movable element 12 and exterior side 18 of first wall section 6, a gliding band 25 is positioned between first wall section 6 and movable element 12. Because of the design of displacement machine 1 according to the present invention, a functional separation between friction and sealing is achieved. Elastomer 4 is completely supported by pressure from the outside. This means that the two elastic wall sections 6, 7 support themselves fully on rigid, non-deformable components. Elastomer 4 is situated having its outer side supported also on the sides not shown in FIG. 1, which can be seen in FIGS. 2A to 4B. First wall section 6 lies completely against sliding band 25 with its outer side 18 opposite its inner side 8, and sliding band 25, in turn, is supported on movable element 12. What is decisive is that elastic wall section 6 is situated not only in the region of press-on section 13, but that it is completely supported. Because of this, the pressure forces acting because of the inside pressure in working chambers 2, 3 are taken up by movable element 12. Elastically designed first wall section 6 forms only a pressure stress transmitter, in this context. The same is true for second elastic wall section 7, which is supported from the outside in a groove or pocket 19, shown in FIGS. 2A to 4B, which has two opposite pocket walls 20, 21 and a pocket floor 22. Consequently, the load that elastomer 4 has to withstand is substantially less than if no complete support were a given, as, for instance, in the case of hose pumps. Furthermore, the sealing effect in sealing region 5 is created elastically supported by pressure because of the profiling.

Displacement machine 1, shown in FIG. 1, may be configured to work both in a translatory and a rotary manner. In the case of a rotary displacement machine 1, what is shown in FIG. 1 is an unrolled representation of the curved component geometries. In this case, moved element 12 is a rotor and pocket 19 is a stator. The functional principle is maintained for both a translatory and a rotary design.

Figure 2A:
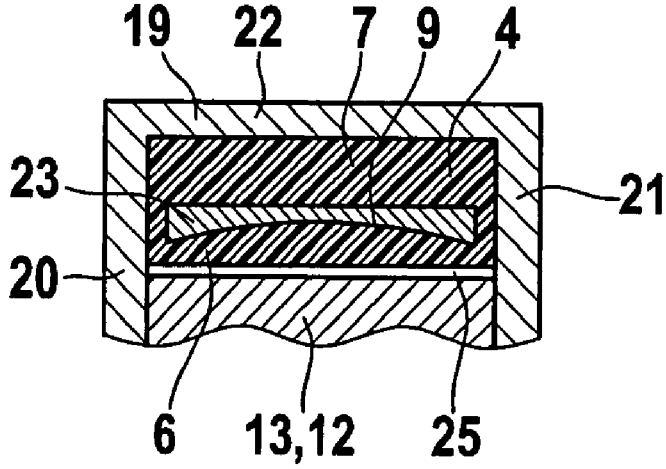
FIG. 2A shows an example embodiment of the displacement machine having a sliding band in a schematic, sectional representation taken along sectional line A-A shown in FIG. 1.
Figure 2B:
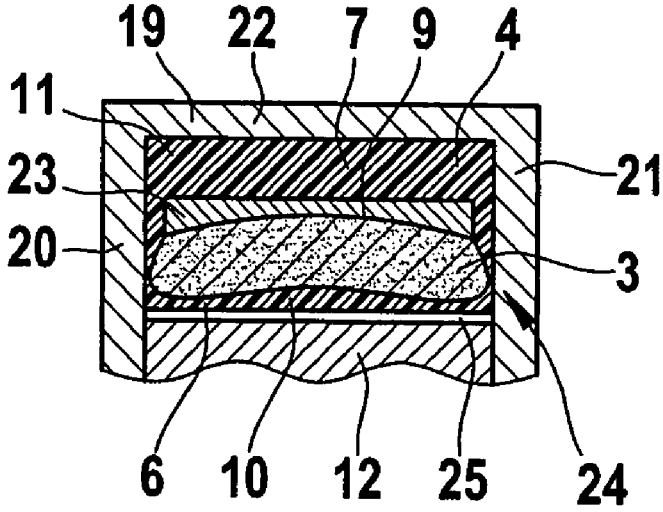
FIG. 2B shows the example embodiment according to FIG. 2A in a schematic, sectional representation taken along sectional line B-B shown in FIG. 1.
Figure 3A:
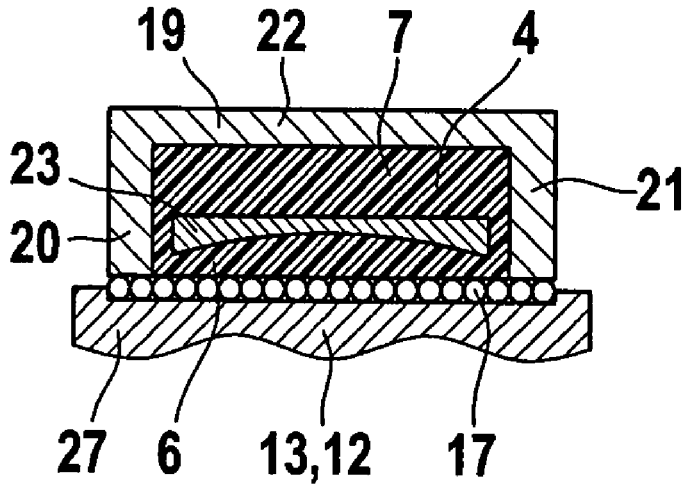
FIG. 3A shows an alternative example embodiment of the displacement machine using a ball belt in a schematic, sectional representation taken along sectional line A-A shown in FIG. 1.
Figure 3B:
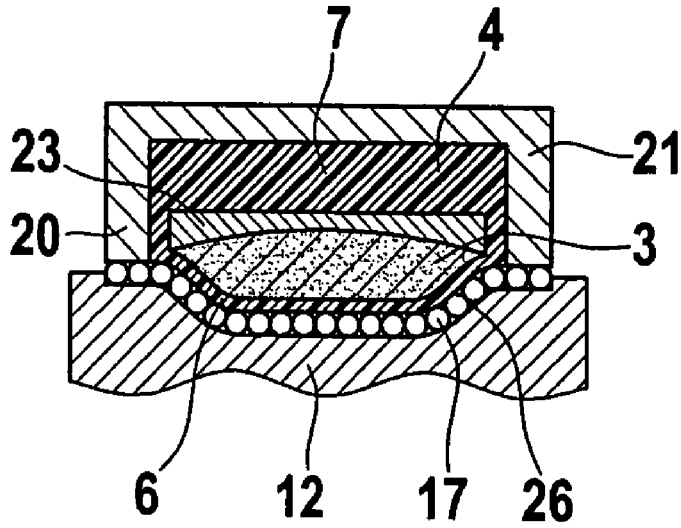
FIG. 3B shows the example embodiment according to FIG. 3A in a schematic, sectional representation taken along sectional line B-B shown in FIG. 1.
Figure 4A:
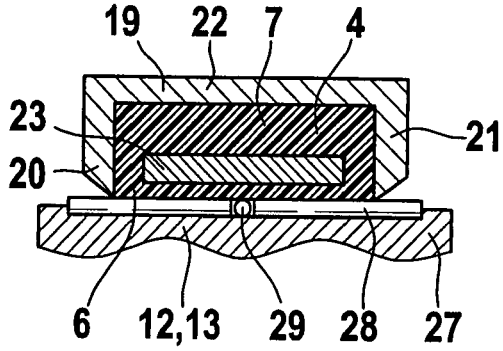
FIG. 4A shows another alternative example embodiment of the displacement machine using a two-part needle roller band in a schematic, sectional representation taken along sectional line A-A shown in FIG. 1.

In FIGS. 2A, 3A, 4A, cross-sectional views of example embodiments of displacement machine 1 are shown, which views are taken in the area of section line A-A displayed in FIG. 1. In an analogous manner to this, FIGS. 2B, 3B, 4B show the cross-sectional profiles in the area of section line B-B displayed in FIG. 1.

In FIGS. 2A and 2B one may recognize that elastomer 4, or rather first wall section 6 and second wall section 7 of working chambers 2, 3 are supported all around. For this, elastomer 4 is accommodated in a U-shaped pocket 19 having a pocket floor 22, and two pocket walls 20, 21 running at right angles thereto and parallel to each other. Instead of ball belt 17 according to FIG. 1, a sliding band 25 was used in the exemplary embodiment according to FIGS. 2A and 2B. First wall section 6 lies against sliding band 25, and thus against movable element 12. Ball belt 17 and sliding band 25 represent a kind of separating layer. This separating layer may be made up of a solid, for instance, graphite, Teflon; of a liquid, such as oil; of a combination of a solid/liquid mixture; of a liquid/gas mixture; of a multiphase mixture; of a sliding lacquer; of a powder; of a porous material; of a porous material mixture such as porous copper structure and graphite; of a porous material or porous mixture whose cavities are filled with a liquid or a multiphase mixture, such as copper structure and oil. In addition, as a method to construct the separating layer, it would also be conceivable to use a needle bearing, a roller bearing, an angular roller bearing, a ball bearing, a tapered roller bearing, a cylindrical roller bearing or a rolling bearing. In the widest sense, one might also consider a combination of the above-named types. Sealing region 5 is shown in FIG. 2A. In that figure, first wall section 6 lies against second wall section 7. Second wall section 7 has a reinforcement layer 23 developed as an intermediate steel layer. In the exemplary embodiment shown, this forms the major part of inner side 9 of second wall section 7, and thus of working chambers 2, 3. However, the intermediate steel layer may also be positioned on the inside of second wall section 7 without direct contact with working chambers 2, 3, or at the outer circumference of elastomer 4. A possible design of the area along sectional line B-B, according to FIG. 1, is shown in FIG. 2B. One may recognize working chamber 3 formed between wall sections 6, 7. In this region, too, elastomer 4 lies with its full circumference against pocket 19 ands sliding band 25, and is able to conduct the pressure forces acting upon it to these components. In lateral region 24, a relative motion between elastomer 4 and pocket wall 21 takes place in response to the moving past of press-on section 13. This relative motion also takes place on pocket wall 20, that lies opposite to pocket wall 21, and elastomer 4. In order to reduce friction, means for friction reduction, for instance, a sliding band, may also be provided between pocket walls 20, 21 and elastomer 4.

In the exemplary embodiment according to FIGS. 3A and 3B, wall section 6 is supported on a ball belt 17. Ball belt 17, in contrast to sliding band 25 according to FIGS. 2A and 2B, is not enclosed by sidewalls 20, 21 of pocket 19, but provides for a low-friction support of movable element 12 both with respect to first wall section 6 and also with respect to pockets 20, 21. As may be seen in FIG. 3B, movable element 12 has trench-like depressions 26. Elastic wall section 6 adapts to the form of these depressions 26, whereby working chambers 2, 3 are formed. As may be seen in FIG. 3*a*, press-on section 13 is developed as a preferably flat partial piece 27 that is raised, compared to depressions 26. A reinforcement layer 23 of steel is also provided in the exemplary embodiment according to FIG. 3A and FIG. 3B.

Figure 4B:
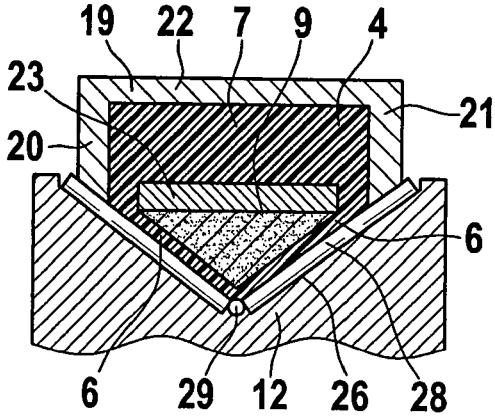
FIG. 4B shows the example embodiment according to FIG. 4A in a schematic, sectional representation taken along sectional line B-B shown in FIG. 1.

In the exemplary embodiment according to FIG. 4A and FIG. 4B, a trench-like depression 26 is also provided, although in this case it is triangular having slanted sidewalls within movable element 12. Two needle roller bands 28 are provided as means for reducing the friction between movable element 12 and first wall section 6. In the middle between needle bands 28 there is a ball race 29. Needle bands 28 reduce the friction both between moved element 12 and first wall section 6 and between moved element 12 and pocket 19. In the exemplary embodiments shown, a reinforcement layer 23 made of plastic is provided. This forms inner wall 9 of second elastic wall section 7.

Figure 5:
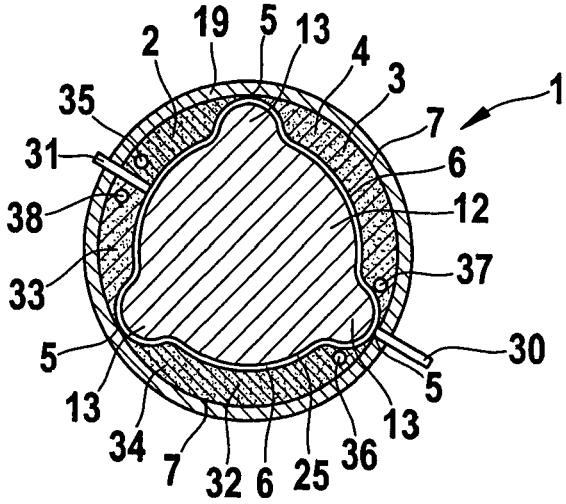
FIG. 5 shows a displacement machine configured as an external vane machine, having a rotor and a stator positioned concentrically with the rotor.

A displacement machine 1 working in rotary fashion is shown in FIG. 5. Movable element 12 is designed as a rotor. A stator 19 is assigned to it concentrically. The displacement machine shown is a dual-flow external vane machine. However, the principle of the present invention is also applicable to other displacement machines, especially to an annular ring machine, to a tape feed roll machine and to displacement machines that work according to the Wankel principle. Displacement machine 1 has two external vanes 30, 31 diametrical that are situated diametrically opposite to each other, which are positively controlled by the outer contour of the rotor. In the radial direction, they are spring-loaded inwardly. Displacement machine 1 has four working chambers 2, 3, 32, 33 that are of variable volume and at a distance from one another in the circumferential direction. Working chambers 2, 3 are introduced into or developed in a common elastomer 4, and working chambers 32, 33 are introduced into or developed in an additional common elastomer 34. If displacement machine 1 is operated as a pump, it sucks in media in working chambers 2, 32 through intake openings 35, 36. With the aid of the rotor and press-on sections 13 the media are then transported in the direction of outlet openings 37, 38 in chambers 2, 33 on the pressure side. Displacement machine 1 shown has three press-on sections 13 that are raised in the radial direction and are at a distance from one another in the circumferential direction, with the aid of which radially inward lying first elastic wall section 6 is pressed against radially outer wall section 7, whereby the traveling sealing regions, and thus working chambers 2, 3 are created. A sliding band 25 is situated between rotor 12 and first wall section 6. First wall section 6 lies with its entire surface against rotor 12. Second wall section 7 is supported on rigid stator 19. In a lateral manner, elastomer 4 and/or first wall section 6 and/or second wall section 7 are also situated so that they are supported, for example, as in the exemplary embodiments according to FIG. 2A to FIG. 4B. It is also conceivable that these regions of elastomer 4 are supported on side disks of displacement machine 1 that are not shown.

What is claimed is:

1. A displacement machine including at least two adjacent working chambers, comprising:

a first wall section made of an elastic material;

a second wall section;

a movable element movable with respect to the first wall section, the movable element having at least one press-on section, wherein the press-on section presses the first wall section against the second wall section to form at least one common sealing region between the at least two adjacent working chambers, whereby the first wall section and the second wall section define the at least two adjacent working chambers; and a friction-reducing arrangement provided between the first wall section and the movable element;

wherein the at least one common sealing region moves with a movement of the at least one press-on section, and wherein at least one of the first wall section and the second wall section has a non-smooth profile on an inner side of the at least two adjacent working chambers.

2. The displacement machine as recited in claim 1, wherein the first wall section is supported on the movable element.

3. The displacement machine as recited in claim 2, wherein the second wall section is made of a non-deformable material.

4. The displacement machine as recited in claim 2, wherein the second wall section is at least partially made of elastic material.

5. The displacement machine as recited in claim 4, wherein each of the first and second wall sections are supported on a non-deformable support component.

6. The displacement machine as recited in claim 1, wherein inner sides of the first and second wall sections have non-smooth profiles, and wherein the profile of the inner side of the second wall section is complementary to the profile of the inner side of the first wall section.

7. The displacement machine as recited in claim 6, wherein the second wall section has a reinforcement layer including at least one of a woven material, plastic and metal.

8. The displacement machine as recited in claim 1, wherein the friction-reducing arrangement includes one of a sliding band, a needle roller band, and a ball belt.

9. The displacement machine as recited in claim 1, wherein the movable element is configured as a rotor, and wherein the at least two adjacent working chambers are situated at a predetermined distance from one another in a circumferential direction, and wherein, upon rotation of the rotor, the at least one common sealing region moves together with the at least one press-on section in the circumferential direction.

10. A displacement machine including at least two adjacent working chambers, comprising:

a first wall section made of an elastic material;

a second wall section; and a movable element movable with respect to the first wall section, the movable element having at least one press-on section, wherein the press-on section presses the first wall section against the second wall section to form at least one common sealing region between the at least two adjacent working chambers, whereby the first wall section and the second wall section define the at least two adjacent working chambers;

wherein the at least one common sealing region moves with a movement of the at least one press-on section, and wherein at least one of the first wall section and the second wall section has a non-smooth profile on an inner side of the at least two adjacent working chambers, wherein the second wall section has a reinforcement layer including at least one of a woven material, plastic and metal, wherein inner sides of the first and second wall sections have non-smooth profiles, and wherein the profile of the inner side of the second wall section is complementary to the profile of the inner side of the first wall section, and wherein the reinforcement layer forms at least a part of the inner side of the second wall section.

11. The displacement machine as recited in claim 10, further comprising:

a friction-reducing arrangement provided between the first wall section and the movable element.

12. A displacement machine including at least two adjacent working chambers, comprising:

a first wall section made of an elastic material;

a second wall section; and a movable element movable with respect to the first wall section, the movable element having at least one press-on section, wherein the press-on section presses the first wall section against the second wall section to form at least one common sealing region between the at least two adjacent working chambers, whereby the first wall section and the second wall section define the at least two adjacent working chambers;

wherein the at least one common sealing region moves with a movement of the at least one press-on section, and wherein at least one of the first wall section and the second wall section has a non-smooth profile on an inner side of the at least two adjacent working chambers, wherein the movable element is configured as a rotor, and wherein the at least two adjacent working chambers are situated at a predetermined distance from one another in a circumferential direction, and wherein, upon rotation of the rotor, the at least one common sealing region moves together with the at least one press-on section in the circumferential direction, and wherein the at least two adjacent working chambers are completely enclosed by an elastic material, and wherein the elastic material is supported: a) radially outwards on a rigid stator; b) radially inwards on the rotor; and c) laterally on one of the rigid stator, the first wall section and the second wall section.

* * * * *